United States Patent [19]

Tanigami et al.

[11] Patent Number: 4,642,278

[45] Date of Patent: Feb. 10, 1987

[54] PHOTOSENSITIVE MEMBER WITH AN INSULATING LAYER OF AMORPHOUS SILICON

[75] Inventors: Yukio Tanigami, Amagasaki; Shuji Iino, Itami; Mitsutoshi Nakamura, Osaka, all of Japan

[73] Assignee: Minolta Camera Kabushiki Kaisha, Osaka, Japan

[21] Appl. No.: 753,596

[22] Filed: Jul. 10, 1985

[30] Foreign Application Priority Data

Jul. 14, 1984 [JP] Japan ..... 59-146198

[51] Int. Cl.[4] ..... G03G 5/14

[52] U.S. Cl. ..... 430/66; 430/84; 430/95

[58] Field of Search ..... 430/57, 65, 84, 95, 430/66

[56] References Cited

U.S. PATENT DOCUMENTS 4,465,750 8/1984 Ogawa et al. ..... 430/57

4,483,911 11/1984 Ogawa et al. ..... 430/65

FOREIGN PATENT DOCUMENTS 2094550A 1/1982 United Kingdom .

*Primary Examiner*—John L. Goodrow

*Attorney, Agent, or Firm*—Burns, Doane, Swecker & Mathis

[57] ABSTRACT

The present invention relates to a photosensitive member having a photoconductive layer of amorphous silicon. On the photoconductive layer, an amorphous silicon insulating layer is formed and this layer includes carbon and an element in Group IIIA of the Periodic Table. The Group IIIA element is included to control the conductivity of the insulating layer in such fashion that the majority carrier thereof is opposite in polarity to the charging polarity.

6 Claims, 2 Drawing Figures

PHOTOSENSITIVE MEMBER WITH AN INSULATING LAYER OF AMORPHOUS SILICON

BACKGROUND OF THE INVENTION

1. Field of the Invention

The present invention relates to a photosensitive member which has a photoconductive layer containing amorphous silicon, and more particularly to a photosensitive member which has an insulation layer formed over the photoconductive layer.

2. Description of the Prior Art

For the past several years, attention has been focused on the application to photosensitive members of amorphous silicon (hereinafter referred to as "a-Si") which is produced by the glow discharge decomposition process or sputtering process. Similarly, attention has been directed to amorphous silicon-germanium (hereinafter referred to as "a-Si:Ge") having improved sensitivity in the region of long wavelengths for use in forming images by a semiconductor laser. Such promising application is attributable to the fact that for use in photosensitive members, a-Si and a-Si:Ge are exceedingly superior to the conventional selenium and CdS materials in resistance to environmetal pollution, heat and abrasion, photosensitive characteristics, etc.

However, a-Si or a-Si:Ge has the drawback of being low in dark resistivity and unusable as it is for a photoconductive layer which also serves as a charge retaining layer. It has therefore been proposed to incorporate oxygen or nitrogen into the material to improve the dark resistivity, but this conversely results in reduced photosensitivity, hence there is a limit to the content of the additive.

To overcome the drawback that the photosensitive member prepared from a-Si has a low dark resistivity and a very high rate of dark decay, it is also proposed to form an insulation layer of carbon-containing a-Si on a photoconductive a-Si layer to give improved charge retentivity (e.g. Published Unexamined Japanese Patent Application SHO No. 57-115551 and U.S. Pat. No. 4,465,750). The former publication discloses that carbon atoms are incorporated into a-Si at a high concentration of 40 to 90 atomic % (hereinafter abbreviated as "at. %"). Nevertheless, high carbon contents result in optical fatigue or reduced sensitivity, whereas improved chargeability requires a higher carbon concentration, which needs to be at least 70 at. % in some cases. Overcoat layers of such high carbon concentration are difficult to make by the common glow discharge decomposition process. The photosensitive member obtained, which has a high carbon concentration, exhibits poor adhesion to the photoconductive layer (of a-Si or a-Si:Ge), possibly creating blank streaks in the copy images obtained. Accordingly there is a limitation to the improvement of chargeability by increasing the carbon content.

SUMMARY OF THE INVENTION

The main object of the present invention is to provide a photosensitive member having a high dark resistivity and outstanding chargeability.

Another object of the invention is to provide a photosensitive member exhibiting excellent dark decay characteristics, having high charge retentivity and capable of giving satisfactory copy images.

Still another object of the invention is to provide a photosensitive member which comprises an a-Si photoconductive layer and an a-Si insulation layer formed over the layer and which is excellent in chargeability, low in residual potential, free of optical fatigue and outstanding in photosensitive characteristics, charge retentivity, surface hardness, moisture resistance and other properties.

These and other objects of the present invention can be fulfilled by a photosenstive member which comprises a photoconductive layer containing amorphous silicon and a light-transmitting insulation layer of amorphous silicon formed over the photoconductive layer and containing carbon, or carbon and oxygen, the photosensitive member being characterized in that the insulation layer is adjusted in polarity with an element in Group IIIA of the Periodic Table so that charges of a polarity opposite to the polarity of charging serve as the majority carrier.

DETAILED DESCRIPTION OF THE INVENTION

Figure 1:
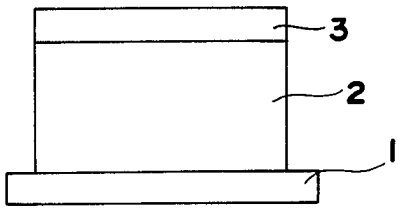
FIG. 1 is a diagram showing the construction of a photosensitive member embodying the invention.

FIG. 1 shows an embodiment of a photosensitive member of the invention to illustrate the construction thereof. The photosensitive member comprises an electrically conductive substrate 1, a photoconductive layer 2 formed over the substrate 1 and at least containing a-Si, and an overcoat layer 3 of insulating and light-transmitting properties formed over the layer 2, containing a-Si and further containing carbon, or both carbon and oxygen.

The photoconductive layer 2 to be provided on the substrate 1 and containing a-Si is formed, for example, by the glow discharge decomposition process and has a thickness of 10 to 100 μm, preferably 10 to 60 μm. This process is practiced, for example, by supplying $SiH_4$, $Si_2H_6$ or like gas as entrained in $H_2$, Ar or like carrier gas into a reaction chamber in which a substrate is placed and which can be evacuated, and causing glow discharge with application of high-frequency power to form a hydrogen-containing a-Si photoconductive layer over the substrate. $GeH_4$ gas may be supplied conjointly to form an a-Si:Ge photoconductive layer. Since the photoconductive layer thus obtained has a lower dark resistivity than is desired, an impurity element (preferably boron) in Group IIIA of the Periodic Table and traces of oxygen, carbon, nitrogen, etc. may be incorporated into the layer.

The overcoat layer 3 containing a-Si and to be provided on the photoconductive layer 2 is formed similarly, for example, by the glow discharge decomposition process to a thickness of 0.01 to 3 μm. The overcoat layer 3 is adapted to have a resistivity which is higher than that of the photoconductive layer 2 and which is substantially constant throughout the entire layer 3 or is progressively increased in the direction of thickness from the interface between the layers 2 and 3 toward the surface of the layer 3. Specifically stated, the overcoat layer 3 contains carbon, or both carbon and oxygen as incorporated in a-Si or a-Si:Ge and further has its polarity adjusted with an element in Group IIIA of the Periodic Table.

As already mentioned, it is known to afford improve photosensitive characteristics by introducing carbon into the a-Si of the overcoat layer and improving the insulating properties of the layer. However, if the carbon content is increased to such an extent as to obtain a remarkably improved chargeability by this technique, problems are encountered during use in that a pattern of blank spots occurs in copy images under the condition of high humidity and that repeated copying cycles impair the adhesion between the overcoat layer and the photoconductive layer to possibly cause separation of the overcoat. Additionally, the increased carbon content reduces the surface hardness, rendering the photosensitive member unsuited to a long period of repeated use.

According to the present invention, the polarity adjustment of the overcoat layer assures high chargeability and eliminates optical fatigue over a suitable range of carbon contents, for example, in the range of 5 to 70 at. % [{number of C atoms/(number of Si atoms+number of C stoms)}×100], preferably 35 to 65 at. %.

The polarity adjustment of the overcoat layer according to the invention is conducted by controlling the valence electrons so that when the photosensitive member is negatively charged, charges of positive polarity serve as the majority carrier in the overcoat layer (p type), or that when the member is positively charged, charges of negative polarity serve as the majority carrier (n type).

When the overcoat layer thus adjusted in polarity is charged, the charges produced are retained in the overcoat layer and inhibited from injection into the photoconductive layer while in the dark, but the photo-carriers produced in the photoconductive layer upon exposure are allowed to move toward the surface easily. Consequently, the photosensitive member exhibits improved chargeability and reduced dark decay and made less susceptible to optical fatigue.

The adjustment of polarity will be described in greater detail. It is now assumed that the photosensitive member shown in FIG. 1 is charged to a predetermined surface potential, for example, of negative polarity. At this time, the negative charges produced on the surface of the overcoat layer act to penetrate into the photoconductive layer 2 from the overcoat layer 3, leading to impaired dark decay and resulting in lowered charge retentivity. According to the present invention, therefore, the overcoat layer is doped with a Group IIIA element to control the valence electrons so as to render the overcoat layer itself serviceable as the p type. In this case, the positive charges serve as the majority carrier and become readily movable, whereas the negative charges become restrained from movement. With the negative charges thus inhibited from injection from the overcoat surface, remarkably improved dark decay is available. When the photosensitive member is exposed to light, holes and electrons are produced in the photoconductive layer. Of these, the electrons move toward the substrate, while the holes move through the overcoat layer to neutralize the negative charges on the overcoat layer. Since the positive charge is the majority carrier as stated above, the holes are readily movable toward the surface at this time, with the result that optical fatigue can be inhibited effectively.

To provide the p-type characteristics, the control of valence electrons is accomplished by doping the covercoat layer with a Group IIIA element, preferably boron, in an amount of 200 to 10000 ppm. Similarly, the n type is available by doping the layer with 5 to 20 ppm of boron. Strongly p-type or n-type characteristics are not desirable because optical fatigue could then result along with impaired chargeability.

The overcoat layer of the present invention may contain oxygen in addition to carbon. Oxygen remarkably improves the light transmitting properties of the overcoat layer. In fact, our experiment has revealed that a photosensitive member with an a-Si overcoat layer containing about 5 at. % of oxygen and 40 at. % of carbon is about 1.8 times higher in photosensitivity than one having a similar layer which contains about 40 at. % of carbon alone. Furthermore, oxygen does not lower but rather improves the surface hardness. Presence of oxygen is also useful for producing satisfactory copy images over a prolonged period of time, free from any disturbance of image or blank spots, even when the photosensitive member is used repeatedly under highly humid conditions. The carbon content, as well as the oxygen content, of the overcoat layer 3 differs depending on whether these contents are substantially uniform throughout the entire layer or have a gradient in the direction of thickness of the layer. When containing these elements uniformly, the layer 3 preferably has a carbon content of about 5 to about 70 at. % and an oxygen content of from a trace to about 10 at. %, based on the a-Si. The lower limits of the carbon and oxygen contents are about 5 at. % and a trace (about 0.1 at. %), respectively, because with lesser amounts of carbon and oxygen present, the overcoat layer fails to have an increased resistivity, is prone to optical fatigue and exhibits insufficient light transmitting properties. Further when the layer contains more than about 70 at. % of carbon or more than 10 at. % of oxygen, the photosensitive member is likely to retain a residual potential or produce disturbed copy images. On the other hand, when the oxygen and carbon contents have a gradient in the direction of thickness of the overcoat layer, each content is made to progressively increase in the direction of the thickness. In this case, the carbon content can be from about 1 to about 60 at. %, and the oxygen content can be from a trace to about 25 at. % if greatest. Furthermore, the carbon content may be constant, with the oxygen content increased progressively, and vice versa. In the latter case, however, the oxygen content should be limited to a maximum of 10 at. %.

Incidentally, the layers 2 and 3 each contain hydrogen.

As compared with the conventional photosensitive member having a protective layer which contains carbon and hydrogen as incorporated in a-Si, the photosensitive member of the present invention has higher chargeability, exhibits lesser dark decay and is free of optical fatigue. Because the outstanding chargeability is available despite the reduced carbon concentration, the present member need not have an exceedingly high carbon concentration. The present photosensitive member is therefore excellent in moisture resistance, abrasion resistance, etc. and produces copy images which are free from blank streaks or blank spots.

The oxygen doping the overcoat layer improves the adhesion between this layer and the photoconductive layer and further eliminates the problems of optical fatigue and impaired transparency which are likely to occur with the a-Si.C-H material of low carbon content.

The present invention will be described with reference to the following examples.

EXAMPLE 1

Figure 2:
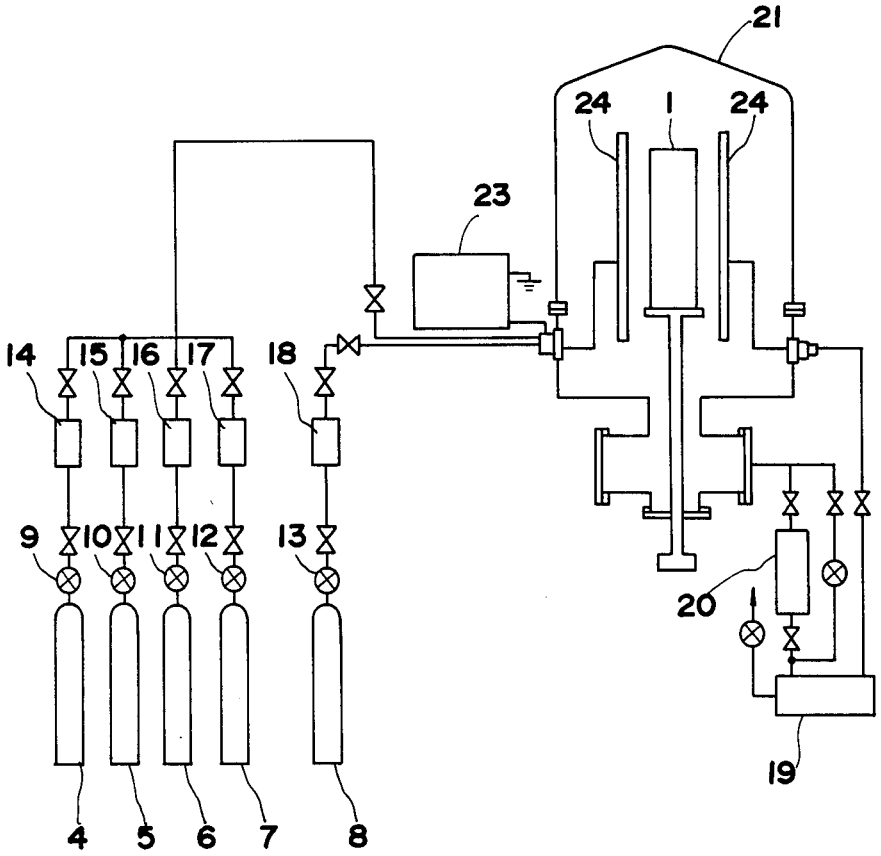
FIG. 2 is a diagram showing a glow discharge decomposition apparatus for producing the photosensitive member of the invention.

With reference to FIG. 2 showing a glow discharge decomposition apparatus, first a rotary pump 19 and then a diffusion pump 20 were operated to evacuate the interior of a reaction chamber 21 to a high vacuum of about $10^{-6}$ torr. Subsequently, first to third and fifth regulator valves 9, 10, 11, 13 were opened to introduce $H_2$ gas from a first tank 4, 100% $SiH_4$ gas from a second tank 5, $B_2H_6$ gas diluted to 200 ppm with $H_2$ from a third tank 6, and $O_2$ gas from a fifth tank 8, with each output pressure gauge adjusted to 1 kg/cm$^2$, into mass flow controllers 14, 15, 16, 18, respectivley. With the mass flow controllers adjusted to a flow rate of 486.5 sccm for $H_2$, to 90 sccm for $SiH_4$, 22.5 sccm for $B_2H_6$ and to 1.0 sccm for $O_2$, the gases were admitted into the reaction chamber 21. After the gas flows stabilized, the internal pressure of the reaction chamber 21 was adjusted to 1.0 torr. On the other hand, an aluminum drum, 80 mm in diameter and serving as the electrically conductive substrate 1, was preheated to 240° C. When the gas flows and the internal pressure stabilized, a high-frequency power supply 23 was turned on to apply power of 250 watts (frequency: 13.56 MHz) across electrodes 24 to cause glow discharge. The glow discharge was continued for about 6 hours to form on the substrate 1 an a-Si photoconductive layer 2 having a thickness of about 20 μm and containing hydrogen, boron and a trace of oxygen.

When the layer 2 was formed, the power supply 23 was turned off, the mass flow controllers were set to a flow rate of 0, and the reaction chamber 21 was fully degassed. Subsequently gases were introduced into the reaction chambers; i.e. $H_2$ gas from the first tank 4 at 486.5 sccm, 100% $SiH_4$ gas from the second tank 5 at 90 sccm, $B_2H_6$ gas from the third tank 6 at 90 sccm, $C_2H_4$ gas from a fourth tank 7 at 135 sccm, and $O_2$ gas from the fifth tank 8 at 10 sccm. With the internal pressure of the chamber adjusted to 1.0 torr, the high-frequency power supply was turned on to apply power of 250 watts. The discharge was continued for 2 minutes to form an overcoat layer 3 having a thickness of about 0.1 μm and containing about 40 at. % of carbon.

The photoconductive member thus obtained was set in a copying machine of the toner image transfer type (Model EP650Z, product of Minolta Camera Kabushiki Kaisha) and used for copying as charged positively. Sharp copy images were obtained with a high density, high resolution and good tone reproducibility. Even after 50,000 continual copying cycles, satisfactory copies were further obtained which were free of any degradation in image characteristics. The photosensitive member was further used for copying under the high-temperature and high-humidity conditions of 30° C., 85% R.H., but no difference was found between the results achieved and those at the room-temperature conditions in electrophotographic characteristics of the member and copy image characteristics.

EXAMPLES 2–4 AND REFERENCE EXAMPLES 1 AND 2

Photosensitive members were prepared in the same manner as in Example 1 with the exception of changing the composition of the reactive gas for forming the overcoat layer. Table 1 shows the gas compositions and the electrophotographic characteristics of the photosensitive members obtained.

TABLE 1

| Example/Reference Example | Ex. 1 | Ex. 2 | Ex. 3 | Ex. 4 | Ref. Ex. 1 | Ref. Ex. 2 |
|---|---|---|---|---|---|---|
| $H_2$ | 486.5 | 486.5 | 486.5 | 486.5 | 486.5 | 586.4 |
| $SiH_4$ sccm | 90 | 30 | 30 | 90 | 30 | 90 |
| $C_2H_4$ sccm (at %) | 135 (40) | 120 (60) | 120 (60) | 135 (40) | 200 (70) | 135 (40) |
| $O_2$ sccm (at %) | 10 (5) | 10 (5) | 0 (0.1) | 10 (5) | 0 (0.1) | 0 (0.1) |
| $B_2H_6$ ($B_2H_6/SiH_4$; ppm) | 200 | 2000 | 10 | 20 | 0 | 20000 |
| Chargeability | | | | | | |
| + | (X) | (X) | | | X | (X) |
| − | | | (X) | (X) | (X) | X |
| Residual potential | | | | | | |
| + | (X) | (X) | | | X | (X) |
| − | | | (X) | (X) | (X) | X |
| Adhesion to overcoat layer | | | | | X | |
| Optical fatigue | | | | | | |
| + | ( ) | ( ) | | | (X) | X |
| − | | | ( ) | ( ) | X | (X) |
| Image characteristics after 50000 copy cycles | | | | | X | X |
| Performance at 30° C., 85% R.H. | | | | | — | X |

Chargeability
: $V_0 \geqq 600$ V (Excellent)
: $300 \text{ V} \leqq V_0 < 600$ V (Good)
X: $V_0 < 300$ V (Poor)

Numerous modifications and variations of the present invention are possible in the light of the above teachings and, therefore, within the scope of the appended claims, the invention may be practiced otherwise than as particularly described.

What is claimed is:

1. A photosensitive member which comprises:

a conductive substrate;

a photoconductive layer of amorphous silicon; and an insulating layer of amorphous silicon formed on said photoconductive layer and including at least carbon and an element in Group IIA of the Periodic table.

2. A photosensitive member which comprises:

a conductive substrate;

a photoconductive layer including amorphous silicon and having a thickness of about 10 to 100 microns; and an insulating layer of about 0.01 to 3 micron thick formed on said photoconductive layer and including amorphous silicon, about 5 to 70 atomic % of carbon and an element in Group IIIA of the Periodic Table, said Group IIIA element being included in an amount to control the majority carrier of said insulating layer to be opposite in polarity to charges produced on said insulating layer.

3. A photosensitive member as claimed in claim 2 wherein said Group IIIA element is included in the amount of about 200 to 10000 ppm for negative charging.

4. A photosensitive member as claimed in claim 2 wherein said Group IIIA element is included in the amount of about 5 to 20 ppm for positive charging.

5. A photosensitive member as claimed in claim 2 wherein said photoconductive layer further includes oxygen in an amount of less than about 10 atomic %.

6. A photosensitive member which comprises:

a conductive substrate;

a photoconductive layer including amorphous silicon and having a thickness of about 10 to 100 microns; and an insulating layer about 0.01 to 3 microns thick formed on said photoconductive layer and including amorphous silicon, about 5 to 70 atomic % of carbon, an element in Group IIIA of the Periodic Table and less than about 10 atomic % of oxygen, said Group IIIA element being included in an amount to control the majority carrier of said insulating layer to be opposite in polarity to charges produced on said insulating layer.

* * * * *